US008777546B2

(12) United States Patent
Lanting et al.

(10) Patent No.: US 8,777,546 B2
(45) Date of Patent: Jul. 15, 2014

(54) SYSTEM FOR ATTACHING A TOOL TO A WORK MACHINE

(75) Inventors: Henry A. Lanting, Dunnville (CA); Scott R. Jamieson, Welland (CA); Radu T. Guja, Welland (CA)

(73) Assignee: Deere & Company, Moline, IL (US)

( * ) Notice: Subject to any disclaimer, the term of this patent is extended or adjusted under 35 U.S.C. 154(b) by 635 days.

(21) Appl. No.: 12/718,004

(22) Filed: Mar. 5, 2010

(65) Prior Publication Data

US 2011/0217153 A1 Sep. 8, 2011

(51) Int. Cl.
*A01B 59/06* (2006.01)
*E02F 3/36* (2006.01)

(52) U.S. Cl.
USPC ..... 414/723; 172/273; 37/468

(58) Field of Classification Search
CPC .... A01B 59/06; A01B 59/062; A01B 59/063; E02F 3/3636; E02F 3/3668; E02F 3/3672
USPC ..... 414/723; 37/468; 172/272–275
See application file for complete search history.

(56) References Cited

U.S. PATENT DOCUMENTS

| | | | | |
|---|---|---|---|---|
| 4,243,356 | A * | 1/1981 | Takojima | 414/723 |
| 5,466,113 | A | 11/1995 | Norberg | |
| 7,001,137 | B2 | 2/2006 | Perrin et al. | |
| 2012/0189374 | A1 * | 7/2012 | Lanting et al. | 403/27 |

* cited by examiner

*Primary Examiner* — Scott Lowe
*Assistant Examiner* — Brendan Tighe

(57) ABSTRACT

A carrier is provided for releasably attaching a tool to the lift arms of a work machine. The carrier comprises a lift arm attachment point for attachment to the lift arm, a tool attachment point for releasable attachment of the tool to the carrier, and a contact pad, for contacting the tool in use. In use, the lift arm and contact pad lie in the same vertical plane. Providing a contact pad between the carrier and tool in line with the lift arm removes any transverse bending forces on the carrier.

12 Claims, 7 Drawing Sheets

SYSTEM FOR ATTACHING A TOOL TO A WORK MACHINE

FIELD OF THE INVENTION

The present invention relates to the attachment of tools to the lift arms of a loader or other work machine.

BACKGROUND OF THE INVENTION

Work machines, such as loaders, are used in many industries, such as farming and construction, and are used to perform many different jobs within each industry. For example, farmers use loaders to move soil as well as lift hay bales and other heavy items. A single machine is able to perform many different tasks by having different tools that can be releasably attached to the loader lift arms. This means that the user need not buy several machines, each dedicated to a particular task, but may use one or a few, multipurpose machines instead. This clearly has advantages in terms of cost.

However, the task of attaching and detaching tools from loaders can be difficult. The tools are typically heavy, weighing upwards of a couple of hundred pounds, and manually maneuvering them is a physically demanding job. The means of attachment itself can also be cumbersome and difficult to operate, particularly during periods of cold weather when the operator will be wearing heavy gloves.

Various arrangements have been proposed to address this problem. For example, U.S. Pat. No. 5,466,113 and U.S. Pat. No. 7,001,137 both disclose latching arrangements for locking a tool to the lift arms of a work machine.

U.S. Pat. No. 5,466,113 discloses the use of a carrier or support, pivotally coupled to the lift arms using a pin, the carrier including two pairs of brackets for receiving an elongate, horizontal locking bar that is used to attach the tool to the carrier. The locking bar can be reciprocated along a horizontal axis between a locking position and an unlocking position. Corresponding brackets on the tool can be positioned in a space between the brackets on the carrier so that in the locking position the locking bar extends through the apertures in the brackets on both the carrier and the tool, thereby securing the tool to the carrier. The elongate locking bar allows the tool to be simply detached and attached to the carrier from one side only.

U.S. Pat. No. 7,001,137 discloses a similar system to that described in U.S. Pat. No. 5,466,113, but with a hydraulic cylinder for moving the locking bar between the locked and unlocked positions.

These systems are effective and user friendly, but suffer from limited durability of the carrier when the carrier is subjected to significant loads in use.

SUMMARY OF THE INVENTION

An object of the present invention is to provide an improved carrier arrangement for attaching a tool to the lift arms of a work machine, that offers the advantages of the prior art but also provides greater durability.

In a first aspect, the invention provides a combination including a lift arm, a tool and a carrier, the carrier coupled to the lift arm and the tool for releasably attaching the tool to the lift arm, the carrier comprising: a lift arm attachment point for attachment to the lift arm; a tool attachment point for releasable attachment of the tool to the carrier; and, a contact pad, for contacting the tool in use; wherein, in use, the lift arm and contact pad lie in the same vertical plane.

The lift arm attachment point may advantageously lie in the vertical plane. The tool attachment point may also advantageously lie in the vertical plane. The tool attachment point may form a part of the contact pad.

Providing a contact pad between the carrier and tool in line with the lift arm removes any transverse bending forces on the carrier. Forces applied to the tool by the lift arm during pushing operations pass directly from the lift arm through the carrier to the tool without placing any shear stresses on the carrier. Likewise, forces applied by the tool to the carrier pass directly to the lift arms. This provides a carrier that allows the tool to be releasably attached to the lift arms, with great durability. Prior carrier arrangements of this type have been found prone to failure due to bending forces applied to the carrier during use.

In a second aspect, the invention provides a carrier for attaching a tool to a pair of lift arms of a work machine, comprising: first and second lift arm attachment points, spaced from one another in a transverse direction, for attachment to the lift arms of a work machine; a tool attachment point for releasable attachment of the tool to the carrier; first and second contact pads, for contacting the tool in use; wherein the first lift arm attachment point and first contact pad lie in a first plane perpendicular to the transverse direction and the second lift arm attachment point and second contact pad lie in a second plane perpendicular to the transverse direction.

The carrier may further comprise a fastener for releasably securing the tool to the carrier at the tool attachment point.

The carrier may include first and second tool attachment points, and the first tool attachment point may lie in the first plane and the second tool attachment point may lie in the second plane. The tool attachment points may be formed within the contact pads. The tool attachment points may comprise an opening formed in each of the contact pads for receiving a corresponding bracket on a tool. The fastener may include a bar that extends through bores formed in the contact pads.

The carrier may comprise a carrier frame and the contact pads may be welded or otherwise fixed to the carrier frame. Alternatively, the contact pads may be integral with a carrier frame. The carrier frame may comprise a pair of parallel walls and the contact pads may extend between the parallel walls.

The lift arm attachment points preferably allow for pivotal movement of the carrier relative to the lift arms about a transverse axis.

The carrier may comprise first and second pairs of upright walls, and a transverse member connecting the first and second pairs of upright walls, wherein the first contact pad is positioned between the first pair of upright walls and second contact pad is positioned between the second pair of upright walls. The first lift arm attachment point may be positioned between the first pair of upright walls and second lift arm attachment point is positioned between the second pair of upright walls.

In a third aspect, the invention provides a combination including a lift arm, a tool and a carrier, the carrier being coupled to the lift arm and the tool for releasably attaching the tool to the lift arm, the carrier comprising: a lift arm attachment point for attachment to the lift arm; a tool attachment point for releasable attachment to the tool; and wherein, in use, the lift arm and tool attachment points lie in the same vertical plane.

In a fourth aspect, the invention provides a carrier for attaching a tool to a pair of lift arms of a work machine, comprising: first and second lift arm attachment points, spaced from one another in a transverse direction, for attachment to the lift arms of a work machine; first and second tool attachment points for releasable attachment of the tool to the carrier; wherein the first lift arm attachment point and flit tool attachment points lie in a first plane perpendicular to the transverse direction and the second lift arm attachment point and second tool attachment point lie in a second plane perpendicular to the transverse direction.

In a fifth aspect, the invention provides a method of attaching a tool to a lift arm of a work machine comprising the steps of: connecting the lift arm to a carrier at a first attachment point on the carrier; and connecting the tool to the carrier at a second attachment point on the carrier such that a contact pad on the carrier abuts the tool, the lift arm and contact pad lying in the same vertical plane.

BRIEF DESCRIPTION OF THE DRAWINGS

The preferred embodiment will be described in detail below with reference to the accompanying drawings wherein.

DESCRIPTION OF THE PREFERRED EMBODIMENT

The term "work machine" as used herein means any vehicle used in the agricultural, construction or forestry industries for performing heavy tasks. Example work machines are loaders and tractors.

The term "lift arm" as used herein covers any type of movable arm on a work machine to which a tool or implement can be attached. A pair of joined together lift arms is sometimes referred to as a "boom"

The term "tool" as used herein can mean any implement or attachment for a work machine, such as a bucket, pallet fork or bale spear.

The term "attachment point" as used herein refers to any mechanical feature that allows for attachment thereto, such as a hook, a ring, an aperture, a passageway, a lug, a bracket, a threaded bore or shaft, a recess, a shelf or shoulder.

The term "contact pad" as used herein means an element that provides an abutment surface through which force can be applied. It is not limited in size or shape and can be discontinuous. It can be designed to fit against the surface of a particular tool or tools.

Figure 1:
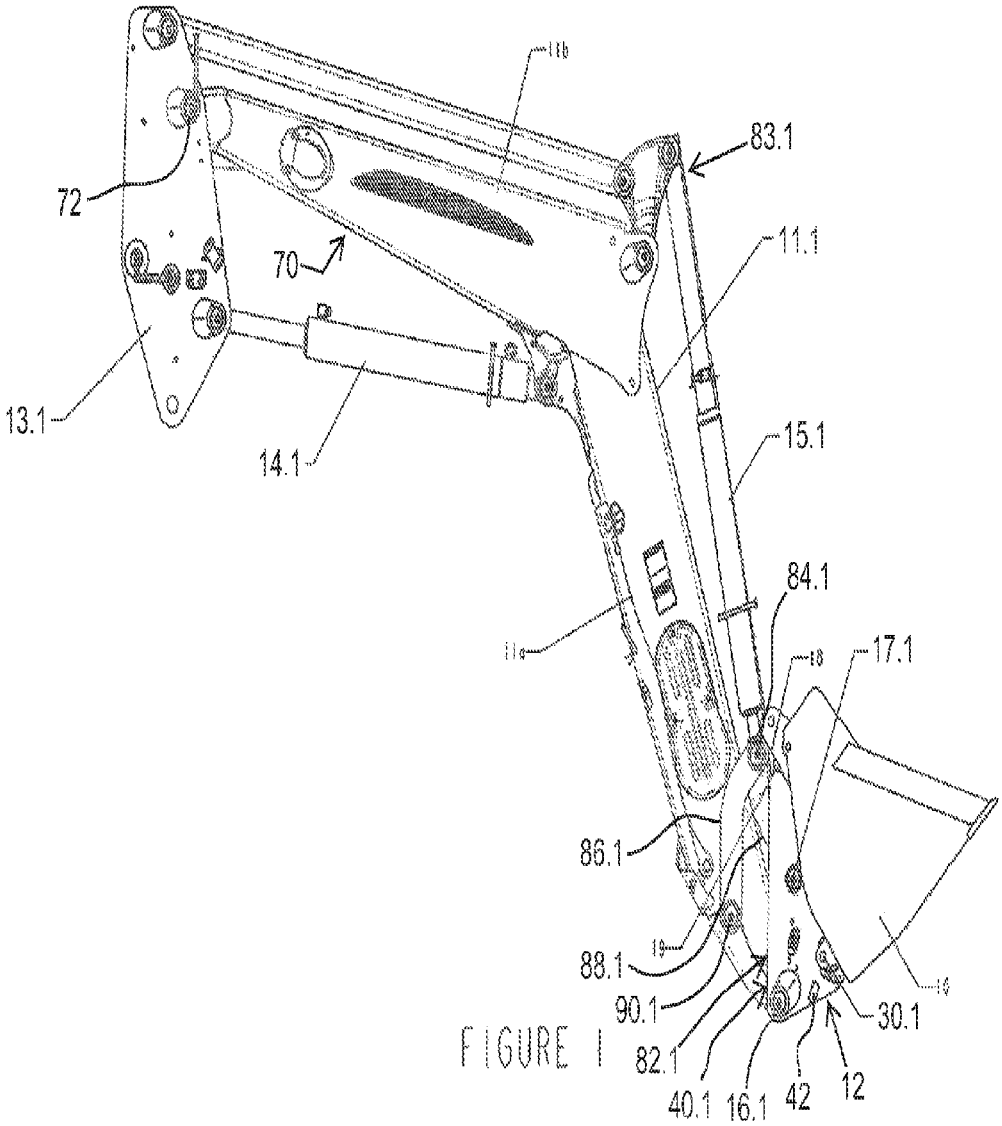
FIG. 1 is a side view of the loader boom of a work machine, with a tool attached to the lift arms using a carrier in accordance with the present invention.
Figure 2:
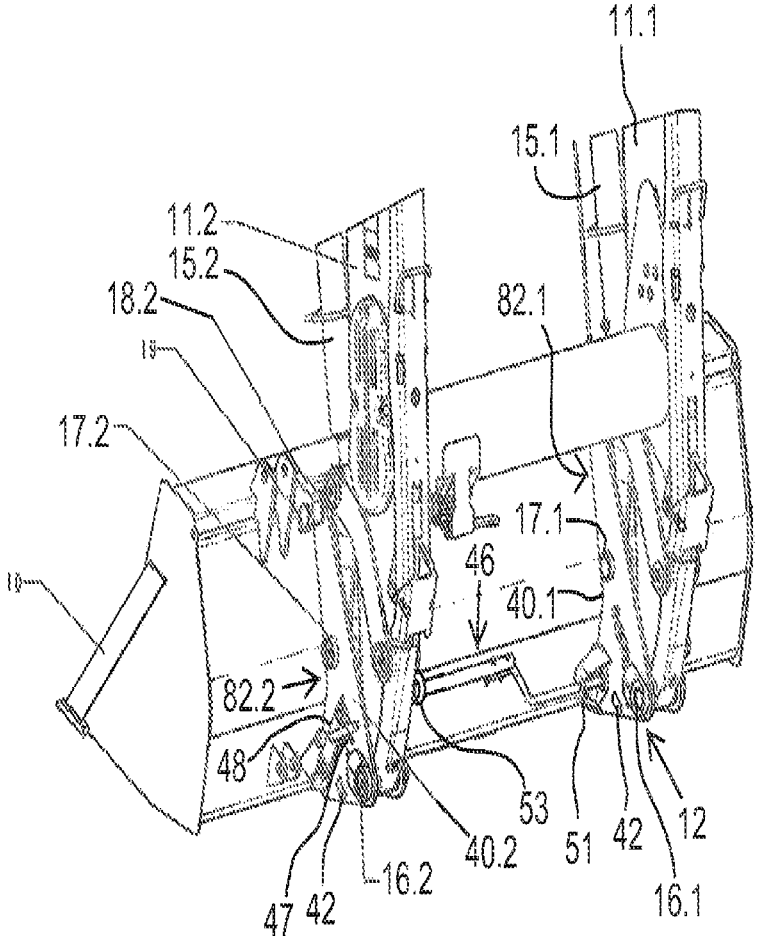
FIG. 2 is a detailed rear perspective view of the carrier attached to the tool and to the loader boom, shown in FIG. 1.

Referring now to FIGS. 1 and 2, there is shown a loader boom 70 comprising parallel first and second lift arms 11.1 and 11.2 of a work machine connected to a tool 10 by a carrier 12 in accordance with the invention. Only the first parallel lift arm 11.1 can be seen in the view of FIG. 1 and it is shown together with a first mast or plate 13.1, which is the only illustrated structure of the work machine. The first lift arm 11.1 has a rear end pivotally attached, as by a pin 72, to the first mast or plate 13.1 so as to pivot about a transverse horizontal axis, with it being noted that the second lift arm 11.2 is similarly connected to a second mast or plate (not shown). Each of the lift arms 11.1 and 11.2 is a defined by two sections 11*a* and 11*b* joined to define an included obtuse angle and can be moved relative to the work machine in a vertical plane. First and second hydraulic rams, of which only the first hydraulic ram 14.1 is shown, are respectively coupled between the first mast 13.1 and the first lift arm 11.1, and between the second mast (not shown and second lift arm 11.2 and are operable to pivot the lift arms 11.1 and 11.2 about their respective pivot connections 72.

The first and second lift arms 11.1 and 11.2 have respective forward ends received between first and second pairs of generally triangular upright walls 40.1 and 40.2 (see also FIG. 3) respectively of first and second tool holders 82.1 and 82.2 of the carrier 12. The first and second lift arms are respectively attached to the first and second holders 82.1 and 82.2 of the carrier at two points. A First and second lift arm attachment points are respectively defined by first and second pairs of apertures 16.1 and 16.2 that are generally aligned in an axial manner and are respectively provided at a lower rear corner region of each wall of the pair of walls 40.1 of the first holder 82.1, and provided at a lower rear corner region of each wall of the pair of walls 40.2 of the second holder 82.2 of the carrier. Third and fourth lift arm attachment points are respectively defined by first and second pairs of apertures 17.1 and 17.2 that are generally aligned in an axial manner and are respectively provided about midway up each wall of the pair of walls 40.1 of the first holder 82.1 and each wall of the pair of walls 40.2 of the second holder 82.2 of the carrier. The carrier 12 is attached to the lift arms 11.1 and 11.2 so as to be pivotable about a horizontal axis, defined by respective pivot pins passing through the attachment point apertures 16.1 and 16.2 respectively of the holders 82.1 and 82.2, by movement of a second pair of hydraulic rams 15.1 and 15.2 (FIG. 2 only), each forming part of a leveling linkage, of which only a first leveling linkage 83.1 is shown (FIG. 1 only), the linkage 83.1 having one end coupled, as at a pivotal connection 84.1, which connects together first ends of a pair of links 86.1 and 88.1, the link 86.1 having a second end pivotally coupled to the lift arm 11.1, as at pivotal connection 90.1, and the link 88.1 having a second end pivotally connected to the attachment point apertures 17.1 by an attachment pin. This type of connection between lift arms and carrier is described in U.S. Pat. No. 7,001,137, the contents of which are incorporated herein by reference.

Figure 5:
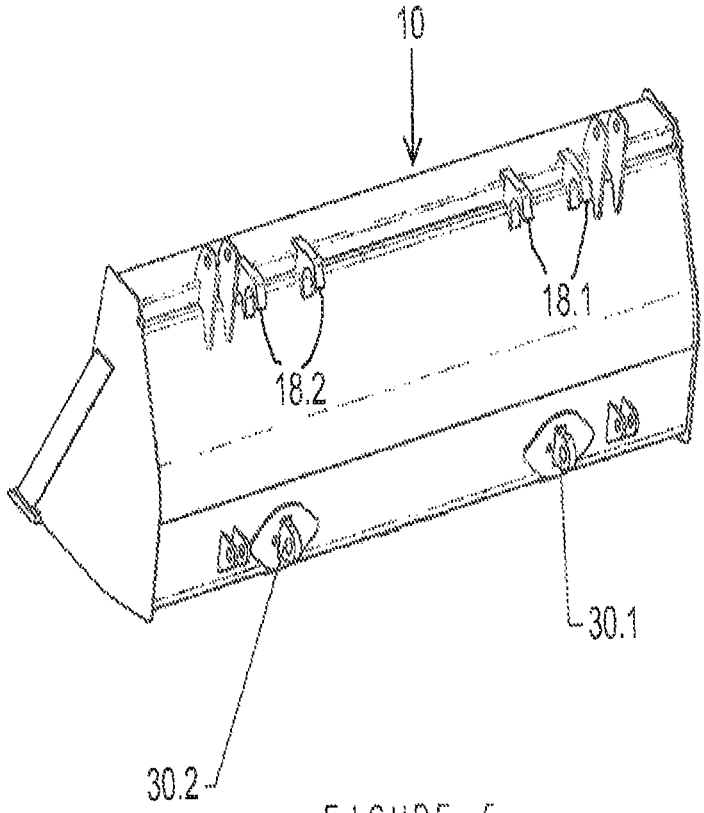
FIG. 5 is a rear perspective view of the tool illustrated in FIGS. 1 to 3.

The tool, in this case a bucket 10, is attached to the carrier 12 at two points. Referring also to FIG. 5, it can be seen that first and second pairs of downwardly opening hooks 18.1 and 18.2 are respectively fixed to upper regions of a backside of the bucket 10 so as to be generally aligned fore-and-aft with the first and second holders 82.1 and 82.2, with each pair of hooks 18.1 and 18.2 being spaced from each other a distance sufficient for upper ends of the holders 82.1 and 82.2 to fit between them. The hooks 18.1 and 18.2 on the bucket engage a transverse bar 19 that forms part of the carrier 12 and extends through upper ends of the holders 82.1 and 82.2 at the top of the carrier. A second pair of attachment points is defined by first and second attachment brackets 30.1 and 30.2 provided at a bottom region of the bucket, as will be described in greater detail.

FIG. 2 shows the arrangement of the bucket 10, carrier 12 and lift arms 11 in more detail. FIG. 2 is a rear perspective view of the attachment of the lift arms to the bucket via the carrier. As can be seen in FIG. 2, there are two lift arms 11 in a parallel, spaced apart relationship.

Figure 3:
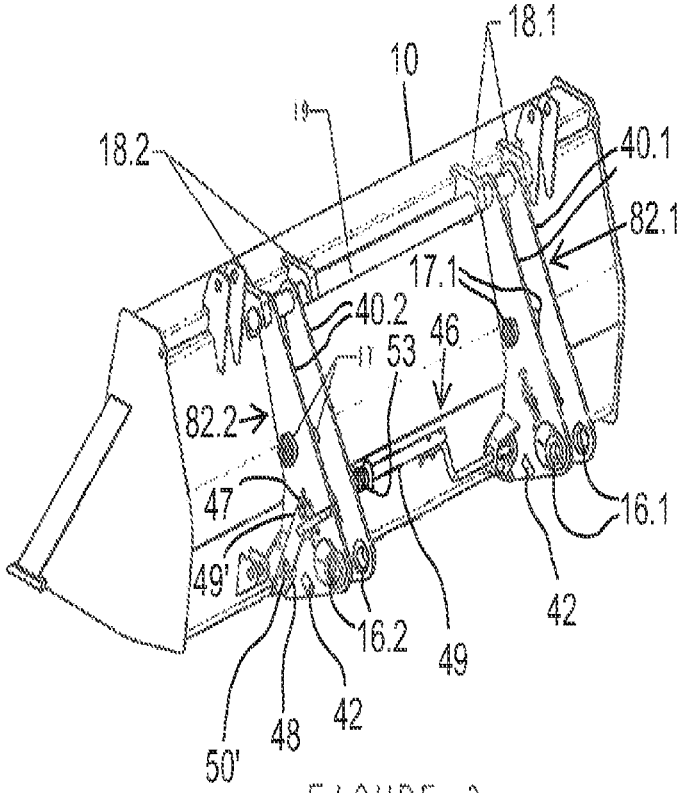
FIG. 3 is a rear perspective view of the carrier and tool of FIGS. 1 and 2, without the loader boom shown.

FIG. 3 is a rear perspective view showing just the bucket and the carrier.

Figure 4A:
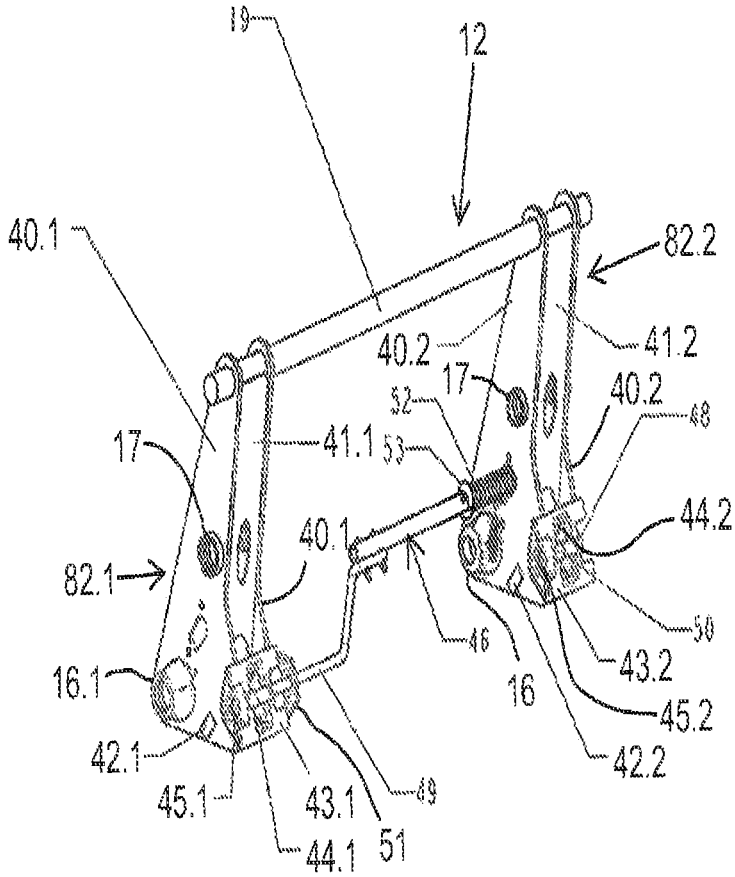
FIG. 4*a* is a rear perspective view of the carrier of FIGS. 1 to 3.
Figure 4B:
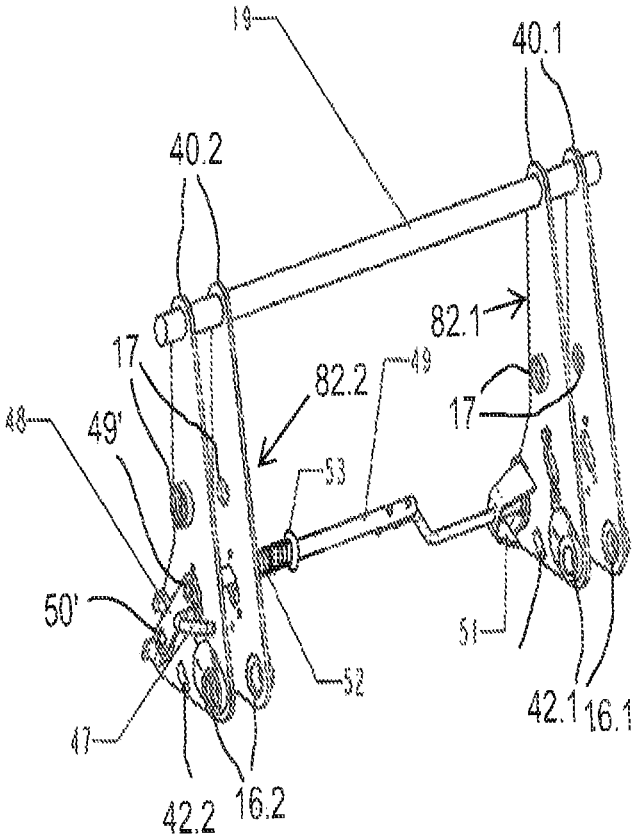
FIG. 4*b* is a front perspective view of the carrier of FIG. 4*a;*
Figure 4C:
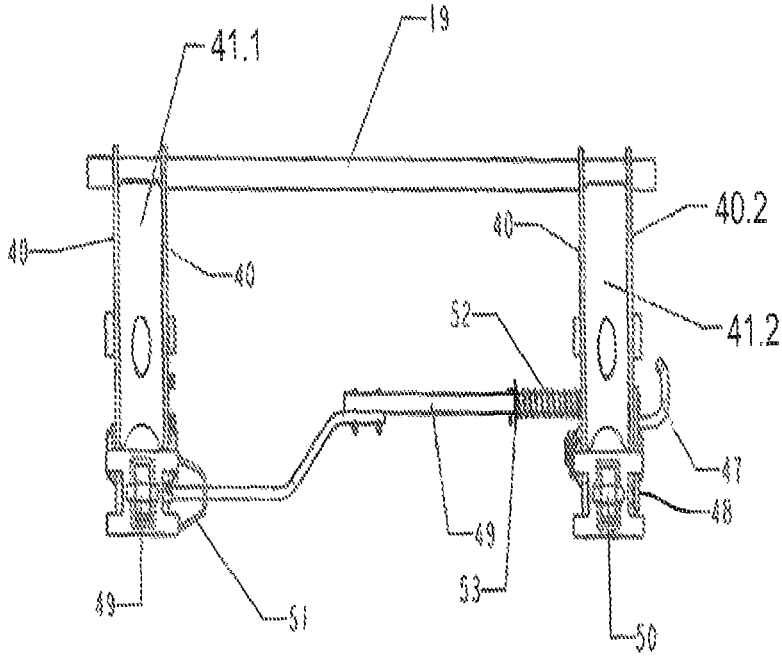
FIG. 4*c* is a front perspective view of the carrier of FIGS. 4*a* and 4*b;*

Referring now to FIGS. 4*a*, 4*b* and 4*c*, it can be seen that the first and second holders 82.1 and 82.2 of the carrier 12 are comprised of the first and second pairs of parallel, vertically extending walls 40.1 and 40.2 which are connected by the transverse bar 19. Each wall of the pairs of parallel walls 40.1 and 40.2 is formed from a steel plate. The pairs of parallel walls 40.1 and 40.2 are spaced from one another the same distance as the lift arms 11.1 and 11.2 are spaced from one another. First and second plates 41.1 and 41.2 (see FIG. 4*c*) are respectively provided between the adjacent walls of the first and second pairs of walls 40.1 and 40.2, and first and second strengthening bars 42.1 and 42.2, of which only rectangular ends are visible, extend between and through the walls 40.1 and 40.2 respectively of the first and second holders 82.1 and 82.2 to provide structural strength. The strengthening bars 42.1 and 42.2 are respectively so located, relative to bottom surfaces of the lift arms 11.1 and 11.2, that when the bucket 10 (FIG. 1) is rotated clockwise to a dump position, about the pins at apertures 16.1 and 16.2, by extension of the hydraulic rams 15.1 and 15.2, the bars 42.1 and 42.2 respectively engage the bottom surfaces of the lift arms 11.1 and 11.2 so as to also function as dump stops for the carrier 12.

The carrier 12 also includes a latching mechanism 46 that extends between, and is supported by, the two pairs of parallel walls 40.1 and 40.2 that comprise the holders 82.1 and 82.2. The latching mechanism 46 will be described in more detail below.

As stated above, the lift arms 11.1 and 11.2 are attached to the carrier 12 using respective pins or bearings that extend through the apertures 16.1 and 16.2 respectively provided in the first and second pairs of carrier walls 40.1 and 40.2 and through a corresponding passage or aperture in the end of the associated one of the lift arms 11.1 and 11.2. Respective 45 mm diameter steel cylindrical gins and circular apertures are used to allow the carrier and/or lift arms to pivot about the pins.

As described above, the lift arm 11.2 is connected to the carrier 12 by a linkage like the linkage connecting the carrier 12 to the lift arm 11.1 which comprises the link 86.1 and the link 88.1 which extends between pinned ends respectively at the pivot connection 90.1 on the lift arm 11.1 and at the attachment point apertures 17.1 on the tool holder 82.1. This arrangement allows the carrier 12 to be tilted relative to the lift arms 11.1 and 11.2 using the hydraulic rams 15.1 and 15.2, as described in U.S. Pat. No. 7,001,137.

It should be noted that each lift arm 11.1 and 11.2, in use, defines a vertical plane of movement, parallel to the plane of the paper in FIG. 1, and that the vertical plane of movement traced by each lift arm passes between and is parallel to each of the corresponding pairs of parallel walls 40.1 and 40.2 respectively of the holders 82.1 and 82.2 of the carrier 12.

With reference to FIGS. 3, 4*a*, 4*b*, 4*c*, and 5 the manner in which the carrier is attached to the bucket will now be described.

As previously described, the bucket includes the first and second pairs of hooks 18.1 and 18.2 that engage the transverse bar 19 at the top of the carrier 12. The transverse bar 19 is a 50 mm diameter steel rod. As shown, the first and second pairs of hooks 18.1 and 18.2 are respectively symmetrically disposed on opposite sides of the first and second pairs of upright walls 40.1 and 40.2. The bucket 10 also has the first and second latch brackets 30.1 and 30.2, shown in FIG. 5, on the lower backside, to which the carrier 12 attaches using a long locking bar 49 and a relatively short locking bar 50 of the latching mechanism 46. The latch brackets 30.1 and 30.2 respectively have first and second apertures extending through them defining respective transverse bores through which the locking bar 49 and the locking bar 50, attached to the locking bar 49, in a manner described in detail below, respectively extend, when the carrier 12 is locked to the bucket 10. The latch brackets 30.1 and 30.2 simply consist of rearward protrusions with the respective apertures extending through them.

Fixed to a lower, front region of each of the pairs of vertical walls 40.1 and 40.2 respectively of the pair of carrier holders 82.1 and 82.2 are respective first and second contact pads 43.1 and 43.2. The latch brackets 30.1 and 30.2 on the bucket 10 respectively extend into openings 44.1 and 44.2 respectively formed in the contact pads 43.1 and 43.2, as shown in FIG. 4*a*. The contact pads 43.1 and 43.2 each have a flat front face that in use contacts the bucket 10 or other tool attached to the carrier 12. The flat front faces are surfaces through which forces from the lift arms or work machine is applied to the tool during a pushing or lifting operation. The contact surfaces of the contact pads 43.1 and 43.2 respectively lie substantially in line with the vertical planes traced by the lift arms 11.1 and 11.2, these planes thus being between the corresponding upright pairs of walls 40.1 and 40.2, and are symmetrical about a vertical center line, as can be clearly seen in FIG. 4*c*. The largest forces that are applied by the work machine through the lift arms are typically when the work machine is performing a pushing operation by driving forward or through a lifting action of the lift arms. By having the contact pads 43.1 and 43.2 in line with the lift arms 11.1 and 11.2 and having the tool attachment points within the contact pads, stress on the carrier 12 is minimized. Stated otherwise, there are no bending forces or transverse loads applied to the carrier 12 because the lift arms 11.1 and 11.2 are directly in line with the contact surfaces and attachment points between the carrier 12 and the tool 10. The carrier 12 acts only to provide a releasable connection between the lift arms 11.1 and 11.2 and the tool 10.

It is possible to provide symmetrically disposed tool attachment points outside of the contact pads 43.1 and 43.2, but having the tool attachment points within the same vertical plane as the contact pads 43.1 and 43.2 and the lift arms 11.1 and 11.2 is the preferred arrangement as it provides the greatest durability for a given amount of material, e.g. for a given thickness of the carrier holder walls 40.1 and 40.2. Other possible variations include providing the tool attachment points in line with the lift arms 11.1 and 11.2 but contact pads disposed, preferably symmetrically, on either side of the tool attachment points in a transverse direction.

The contact pads 43.1 and 43.2 in the embodiment of FIGS. 4*a*, 4*b* and 4*c* are formed from cast steel and are each welded to a respective pair of the upright walls 40.1 and 40.2. However, they may be integrally formed with the walls or attached in some other suitable way such as brazing, using epoxy, or mechanical fasteners such as bolts or rivets. The contact pads 43.1 and 43.2 are symmetrical, so a single design can be used for both sides of the carrier 12.

As described, respectively located within the front faces of the contact pads 43.1 and 43.2 are openings 44.1 and 44.2 to receive the latch brackets 30.1 and 30.2 of a tool. The first and second contact pads 43.1 and 43.2 are each provided with opposite side walls and include respective bores defined by apertures 45.1 and 45.2 formed in the opposite side walls that align with the respective apertures formed in the corresponding first and second latch brackets 30.1 and 30.2 on the tool so that when the contact pads are correctly positioned in contact with the tool, the apertures 45.1 and 45.2 in the contact pads align with the apertures in the latch brackets 30.1 and 30.2, and the transverse locking bars 49 and 50 of the latching mechanism 46 can respectively pass through the contact pad apertures 45.1 and the aperture in latch bracket 30.1, and pass through the contact pad apertures 45.2 and aperture in latch bracket 30.2 to fix the tool to the carrier.

The latching mechanism 46 is similar in construction to that described in U.S. Pat. No. 7,001,137 and will now be briefly described. The latching mechanism 46 operates to attach the carrier 12 to the tool 10 at the tool attachment points and may be operated from one side of the carrier 12 to latch and unlatch the tool from the carrier. The locking bars 49 and 50 of the latching mechanism 46 are made of steel and respectively extend through the bores 45.1 and 45.2 in the first and second contact pads 43.1 and 43.2 when in a locked position. A handle 47 is attached to the locking bars 49 and 50 by a linking arm 48 to allow a user to move the locking bars between locked and unlocked positions. Specifically, as can best be seen in FIGS. 3, 4*b* and 4*c*, the linking arm 48 is in the form of a flat plate located adjacent an outer surface of the outermost wall 40.2 of the second pair of walls 40.2 of the second carrier holder 82.2 and contains two spaced apertures in which ends 49' and 50' of the locking bars 49 and 50 are respectively received and fixed, and also shown fixed to the linking arm 48 is a first end of one leg of a rod bent to form two legs, joined approximately at a right angle so as to define the handle 47. The long locking bar 49 extends toward the first carrier holder 82.1 from the linking arm 48 through oval-shaped apertures located in each of the pair of upright walls 40.2, through a bore provided in the bottom of a U-shaped retaining bracket 51 projecting toward the second carrier holder 82.2 from, and having leg ends fixed to, the inner surface of the inner one of the pair of upright walls 40.1 of the first carrier holder 82.1, and then through the bore in the first contact pad 43.1 on the first pair of upright walls. The short locking bar 50, comprising a 30 mm diameter pin, extends toward the first carrier holder 82.1 from the linking arm 48 and through the apertures 45.2 defining the bore in the contact pad 43.2 on the pair of upright walls of the second carrier holder 82.2. The long locking bar 49 as shown is formed in two parts. A straight section of the locking bar 49 is one part and it is fixed to and extends toward the first carrier holder 82.1 from the linking arm 48 and is joined to a second part, comprising a dog-legged section, using bolts. A first end portion of the dog-legged section is formed as a 30 mm diameter pin that extends into the bore formed in the U-shaped retaining bracket 51 and the apertures 45.1 defining the bore in the first contact pad 43.1.

The long locking bar 49 has a washer 53 slidably mounted thereon and stopped by a cross bolt extending through the bar at a location spaced inwardly from the innermost wall 40.2 of the second pair of walls 40.2. A helical spring 52 is positioned on the locking bar 49 between the washer 53 and the innermost upright wall of the second pair of walls 40.2 to bias the locking bars 49 and 50 into a locked position.

The locking bars 49 and 50 are moved to an unlocked position by a user pulling on the handle 47 against the bias of the spring 52. In the unlocked position, the locking bars are pulled out of engagement with the latch brackets 30.1 and 30.2 on the bucket 10. The bucket can then be simply disengaged from the carrier 12 by moving the carrier downwards and out of engagement with the hooks 18.1 and 18.2. The same process can be carried out in reverse to attach and lock a tool to the carrier.

The retaining bracket 51 is provided to retain and support the long locking bar 49 in alignment with the apertures 45.1 in the contact pad 43.1 when in the unlocked position. The retaining bracket is formed from steel and is welded to the innermost one of the first pair of upright walls 40.1.

The retaining bracket is formed from steel and is welded to one of the upright walls 40.

Advantageously, the locking bars can be held in an unlocked position. For example, the mechanism described in U.S. Pat. No. 7,001,137 or U.S. Pat. No. 5,466,113, the contents of which are incorporated herein by reference, may be used.

An automated mechanism for operating the latching mechanism may be provided, as described, for example, in U.S. Pat. No. 7,001,137.

Having described the preferred embodiment, it will become apparent that various modifications can be made without departing from the scope of the invention as defined in the accompanying claims.

The invention claimed is:

1. A combination including first and second lift arms, a tool and a carrier including first and second tool holders, the first and second tool holders of the carrier being respectively pivotally coupled to the first and second lift arms for pivoting about a transverse pivot axis and the carrier including a latching mechanism operably coupled to the tool for releasably attaching the tool to the lift arms, the combination further comprising:

said tool including first and second latch brackets projecting toward said carrier from a rear side of said tool, with each latch bracket being provided with a transverse aperture;

said first and second tool holders of said carrier respectively including first and second a contact pads respectively having first and second contact surfaces contacting respective rear side locations of the tool and respectively having first and second transverse bores disposed in axial alignment with the transverse apertures in the first and second latch brackets; and said latching mechanism including first and second locking bars that respectively extend through the first and second transverse bores of the contact pads and through the transverse apertures of said first and second latch brackets when the tool is attached to the carrier.

2. The combination of claim 1, wherein the first and second latch brackets are respectively located in vertical planes traced by said first and second lift arms when they pivot vertically about said transverse axis.

3. The combination of claim 1, wherein the pivotal connections of said first and second lift arms respectively with said first and second holders of the carrier are respectively located in the vertical planes traced by said first and second lift arms.

4. The combination according to claim 1, wherein the first and second holders of the carrier respectively comprise first and second pairs of upright walls, and a transverse member connecting each of the first and second pairs of upright walls, wherein the first contact pad is positioned between the first pair of upright walls and the second contact pad is positioned between the second pair of upright walls.

5. The combination according claim 4, wherein the first latch bracket of the tool is positioned between the first pair of upright walls and is received in an opening provided in the first contact pad and wherein the second latch bracket of the tool is positioned between the second pair of upright walls and is received in an opening provided in the second contact pad.

6. A carrier for attaching a tool to a pair of lift arms of a work machine, comprising:

first and second rear regions respectively defining first and second lift arm attachment points spaced from one another in a transverse direction, for attachment to the lift arms of a work machine;

first and second transversely spaced contact pads respectively located at first and second front regions of the carrier and respectively including right and second contact surfaces facing forwardly for engaging back side regions of the tool when in use;

first and second tool attachment points spaced from one another in the transverse direction and respectively comprising first and second fore-and-aft extending openings respectively located in the first and second contact pads for respectively receiving first and second latch brackets extending rearwardly from a tool and containing transverse latching apertures for receiving latch bars for the releasable attachment of the tool to the carrier; and wherein the first lift arm attachment point and first contact pad lie in a first plane perpendicular to the transverse direction and the second lift arm attachment point and second contact pad lie in a second plane perpendicular to the transverse direction.

7. The carrier of claim 6, further comprising first and second pairs of upright walls, and a transverse member connecting the first and second pairs of upright walls, wherein the first contact pad is positioned between the first pair of upright walls and the second contact pad is positioned between the second pair of upright walls.

8. The carrier of claim 7, wherein the first lift arm attachment point is positioned between the first pair of upright walls and the second lift arm attachment point is positioned between the second pair of upright walls.

9. The carrier of claim 6, wherein said first and second contact pads respectively define first and second transverse bores positioned for alignment with the transverse apertures in the first and second latch brackets when a tool is in position for being releasably secured to the carrier; and the carrier further comprising a latching mechanism including first and second locking bars respectively releasably received in said transverse bores, the latching mechanism being operable for simultaneously inserting the first and second locking bars through the aligned transverse bores and the transverse apertures in the latch brackets for releasably securing the tool to the carrier at the tool attachment points.

10. A carrier for attaching a tool to a pair of lift arms of a work machine, comprising:

first and second lift arm attachment points, spaced from one another in a transverse direction, for attachment to the lift arms of a work machine;

first and second tool attachment points for releasable attachment of the tool to the carrier;

first and second contact pads, for contacting the tool in use;

a fastener for releasably securing the tool to the carrier at the tool attachment points; and wherein the first lift arm attachment point and first contact pad lie in a first plane perpendicular to the transverse direction and the second lift arm attachment point and second contact pad lie in a second plane perpendicular to the transverse direction, and wherein the fastener comprises bars that extend through apertures formed in each of the contact pads.

11. The carrier of claim 10, wherein the fastener comprises a handle that is operable to disengage the fastener from both attachment points.

12. The carrier of claim 6, wherein the lift arm attachment points allow for pivotal movement of the carrier relative to the lift arms about a transverse axis.

* * * * *